United States Patent [19]

Masaki et al.

[11] 4,351,480

[45] Sep. 28, 1982

[54] FUEL INJECTION VALVE FOR AN AUTOMOTIVE VEHICLE

[75] Inventors: Kenji Masaki, Yokohama; Masaaki Saito, Yokosuka, both of Japan

[73] Assignee: Nissan Motor Company Limited, Yokohama, Japan

[21] Appl. No.: 202,354

[22] Filed: Oct. 30, 1980

[30] Foreign Application Priority Data

Nov. 7, 1979 [JP] Japan ..... 54-154507

[51] Int. Cl.[3] ..... B05B 1/14

[52] U.S. Cl. ..... 239/585

[58] Field of Search ..... 239/585; 251/139, 141

[56] References Cited

U.S. PATENT DOCUMENTS 4,030,668 6/1977 Kiwior ..... 239/585

FOREIGN PATENT DOCUMENTS 2834844 3/1979 Fed. Rep. of Germany ..... 239/585
2401326 7/1978 France ..... 239/585
1305437 1/1973 United Kingdom ..... 239/585 X
1504873 3/1978 United Kingdom ..... 239/585 X
1541676 3/1979 United Kingdom ..... 239/585 X

*Primary Examiner*—Robert B. Reeves
*Assistant Examiner*—Gene A. Church
*Attorney, Agent, or Firm*—Schwartz, Jeffery, Schwaab, Mack, Blumenthal & Koch

[57] ABSTRACT

A fuel injection valve for an automotive vehicle is disclosed which is provided with a saw-toothed solenoid in place of an ordinary solenoid. In spite of a small size, the fuel injection valve thus improved can control fuel injection timing and period electromagnetically at a high speed under a high fuel pressure. The valve element can be controlled by a current signal flowing through the solenoid coil, so that the valve element is opened or closed against the force of valve spring.

4 Claims, 4 Drawing Figures

FUEL INJECTION VALVE FOR AN AUTOMOTIVE VEHICLE

BACKGROUND OF THE INVENTION

1. Field of the Invention

The present invention relates generally to a fuel injection valve for an automotive vehicle and more specifically to a saw-toothed solenoid type fuel injection valve by which fuel injection timing and period can be controlled electromagnetically at a high speed under a high fuel injection pressure.

2. Description of the Prior Art

An electromagnetic fuel injection valve for controlling fuel injection rate for an automotive engine has been used with an electrically controlled fuel injection unit for supplying fuel into the intake channel of an engine. However, since the injection valve can be used only under a low fuel injection pressure such as several $kg/cm^2$, it is impossible to use this valve in order to directly inject fuel into a high-pressure combustion chamber such as those used with diesel engines.

On the other hand, in the case of a diesel engine or an injection-in-cylinder type engine with ignition plugs, it is important to accurately control the fuel injection timing and fuel injection period from the standpoints of improving the fuel consumption rate and exhaust gas quality (against excess unburned hydrocarbon content). However, it has heretofore been impossible to sufficiently and accurately control the injection timing and the period by the use of conventional mechanical fuel injection valves which are opened or closed only by fuel pressure.

Therefore, there has been a strong need for an electromagnetic fuel injection valve whose open/close timing can be easily and freely controlled. However, fuel injection pressure may be as high as approximately 100 $kg/cm^2$ and therefore it is necessary to press the valve against the valve seat by a high tension spring; accordingly, a solenoid having a great actuating power is needed in order to open or close the valve element freely. Consequently, the solenoids used are large in shape and heavy in weight, thus resulting in slower responsiveness when used with a high speed engine such as an injection-in-cylinder type engine with ignition plugs.

BRIEF SUMMARY OF THE INVENTION

With these problems in mind, therefore, it is the primary object of the present invention to provide an electromagnetic, small-sized, high-speed, fuel injection valve.

To achieve the above mentioned object, the fuel injection valve of the present invention comprises a saw-toothed solenoid in place of an ordinary solenoid.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The features and advantages of the fuel injection valve according to the present invention will be more clearly appreciated from the following description taken in conjunction with the accompanying drawings in which like reference numerals designate corresponding elements, and in which.

DETAILED DESCRIPTION OF THE PREFERRED EMBODIMENTS

Figure 1:
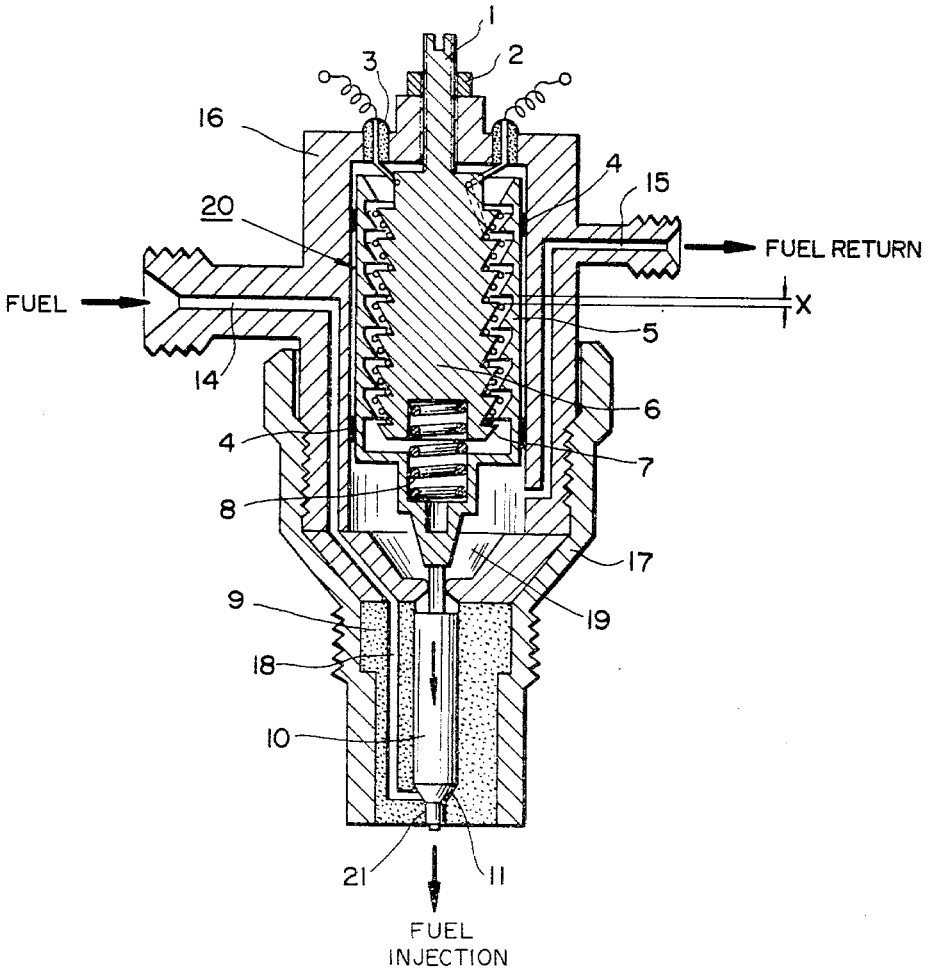
FIG. 1 is a vertical sectional view of a first embodiment of the fuel injection valve according to the present invention.

FIG. 1 illustrated a first preferred embodiment of the saw-toothed solenoid type fuel injection valve of the present invention.

In the figure, the reference numeral 20 denotes a saw-toothed solenoid unit. A cylindrical solenoid holder 16 and a valve holder 9 are assembled concentrically in a housing 17. Within the solenoid holder 16, the saw-toothed solenoid unit 20 which comprises a saw-toothed armature 5, a saw-toothed core 6, and a helical coil 7 is housed to produce an actuating force to urge a needle valve element 10 against a valve seat 11 when a current is passed through the helical coil 7.

On the inner surface of the armature 5 and on the outer surface of the core 6, a number of saw-toothed grooves are formed facing each other, and a helical coil 7 is wound around the outer surface of the core 6.

The armature 5 is slidably supported within the solenoid holder 16 by two bearings arranged upper and lower positions therein; the core 6 is adjustably fixed to the solenoid holder 16 by a gap adjust screw 1 and a lock nut 2. Therefore, it is possible to properly determine the gap (shown by X in FIG. 1) of the saw-toothed grooves between tthe core 6 and the corresponding armature 5 (approximately 1 mm at its maximum). In this case, the saw-toothed solenoid unit 20 can produce an actuating force of around 40 kg when the armature 5 is 42 mm in total length and 22 mm in external diameter.

The numeral 3 denotes a terminal for supplying a current to the helical coil 7.

On one end of the armature 5, a needle valve element 10 is connected, and a compression spring 8 is assembled between the armature 5 and the core 6 in order to close the valve by urging the needle valve element 10 against a taper-shaped valve seat 11.

In the valve holder 9, a fuel passageway 18 is formed to communicate a fuel inlet 14 with a nozzle 21. Therefore, if fuel pressure rises high, the needle valve is pushed up in the axial direction by the pressure applied thereto, so that the fuel is directly injected into a combustion chamber from the nozzle 21.

On the other hand, since fuel seeps into the cavity 19 through between the needle valve 10 and the valve holder 9, it is necessary to recirculate the seepage fuel from a fuel return outlet 15 to a fuel pump (not shown) on the suction side.

Operation of the fuel injection valve described above will be explained hereinbelow.

Generally, the saw-toothed solenoid unit 20 has several features such as a quick response and large actuating force, although the effective stroke is relatively small as compared with an ordinary solenoid. This is because the structure of saw-toothed grooves increases the effective area of the armature 5 and the magnetic flux density of the helical coil 7, while decreasing the weight of the armature 5 in proportion to its great actuating force.

The needle valve element 10 is pushed against the valve seat 11 by the force of the spring 8 and, in this embodiment, the spring force is set to approximately 80 percent of the conventional value.

When a current is passed through the helical coil 7 of the saw-toothed solenoid unit 20, since the actuating force (valve-closing force) is exerted on the needle valve element 10 through the armature 5, the needle valve element 10 can close the valve firmly against the fuel pressure without any seepage through between the valve holder 9 and the needle valve element 10.

In this situation, if the current to the solenoid 20 is cut off or reduced, since the fuel pressure (component of force in valve axial direction) pushes the needle valve element 10 up overcoming the spring force, fuel is injected out from through the nozzle 21.

Therefore, when a fuel pressure greater than the spring pressure is applied to the needle valve element 10, the needle valve 10 is opened the moment the solenoid 20 is deenergized and is closed the moment the solenoid 20 is energized. Accordingly, it is possible to freely control fuel injection timing, fuel injection period, and fuel injection pressure in accordance with an electrical signal supplied to the helical coil 7 of the saw-toothed solenoid unit 20.

With an injection-in-cylinder type engine, although the optimum fuel injection timing and the optimum fuel injection pressure changes according to the engine operating conditions, it is possible to markedly improve the fuel consumption rate and exhaust gas quality by controlling the timing and the pressure correctly.

In this embodiment, especially, since fuel is injected when current to the saw-toothed solenoid unit 20 is cut off, the fuel injection valve has high-speed responsiveness, and thus is applicable for use with a high-speed engine.

Figure 2:
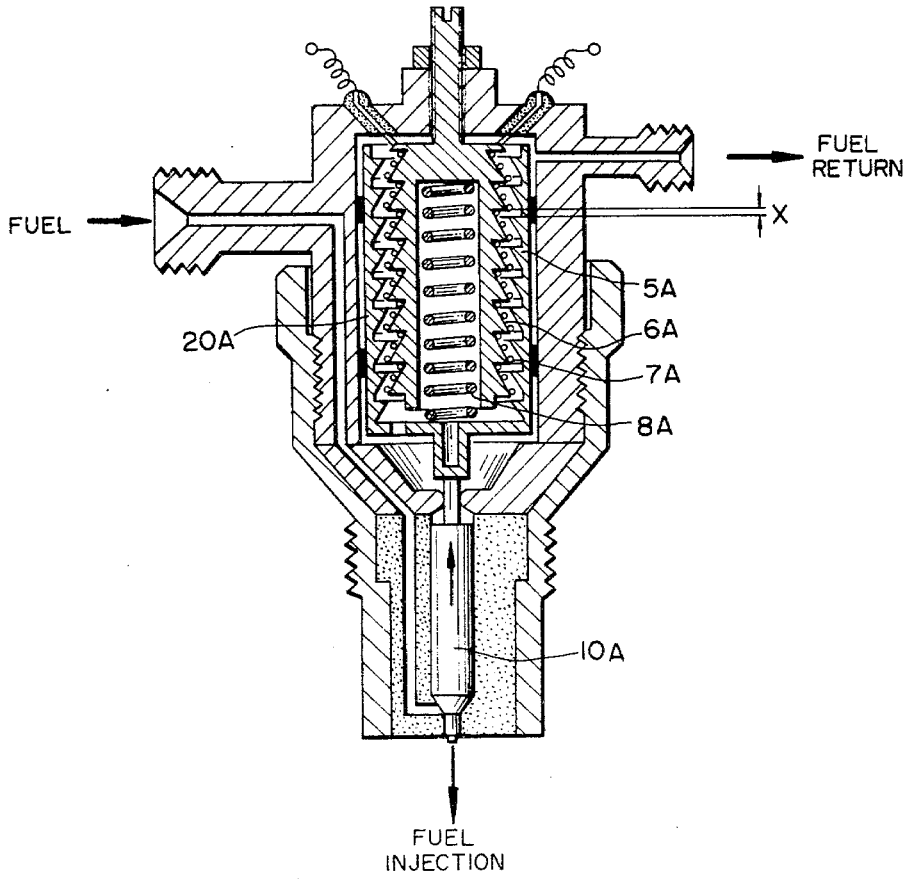
FIG. 2 is a vertical sectional view of a second embodiment of the present invention.

FIG. 2 shows a second embodiment of the present invention. In this embodiment, the direction of the saw-toothed solenoid unit 20A is opposite to that shown in FIG. 1, so that the needle valve element 10A is pulled up against the force of the spring 8A when a current is flowed through the solenoid unit 20A. That is to say, the saw-tooth directions of the armature 5A, and the core 6A, and the direction of current flowing through the helical coil 7A are predetermined in the opposite direction when compared with the first embodiment. In addition, the force of the spring 8A is predetermined within a range smaller than the sum of solenoid force and valve axial force caused by fuel pressure but greater than the valve axial force. In this embodiment, also, it is possible to control fuel injection, with high responsiveness, by controlling the current flowed through the solenoid unit 20A.

Figure 3:
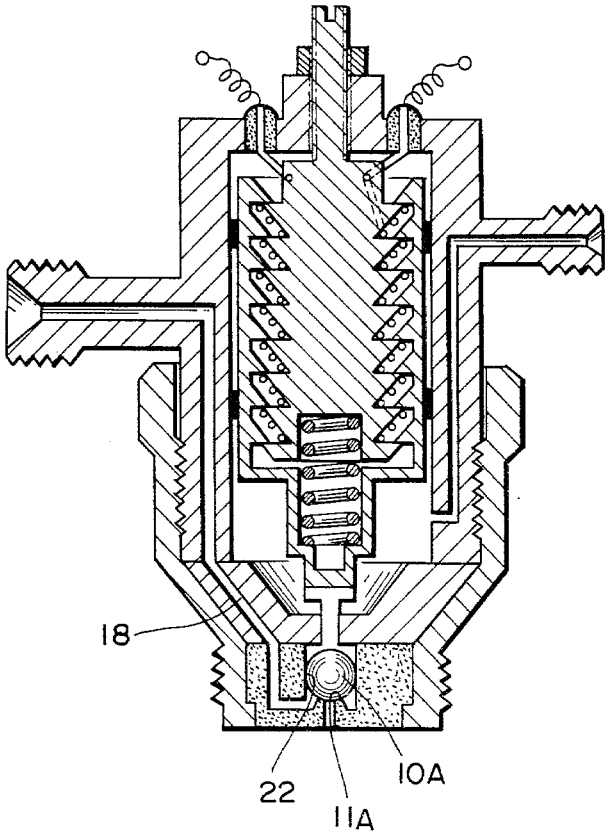
FIG. 3 is a vertical sectional view of a third embodiment of the present invention.

FIG. 3 shows a third embodiment of the present invention. In this embodiment, a ball valve 10A is provided in place of the needle valve. A fuel passageway 18 communicates with a ball guide hole 22 so as to apply fuel pressure to the lower side of the ball valve 10A seating against a valve seat 11A.

Figure 4:
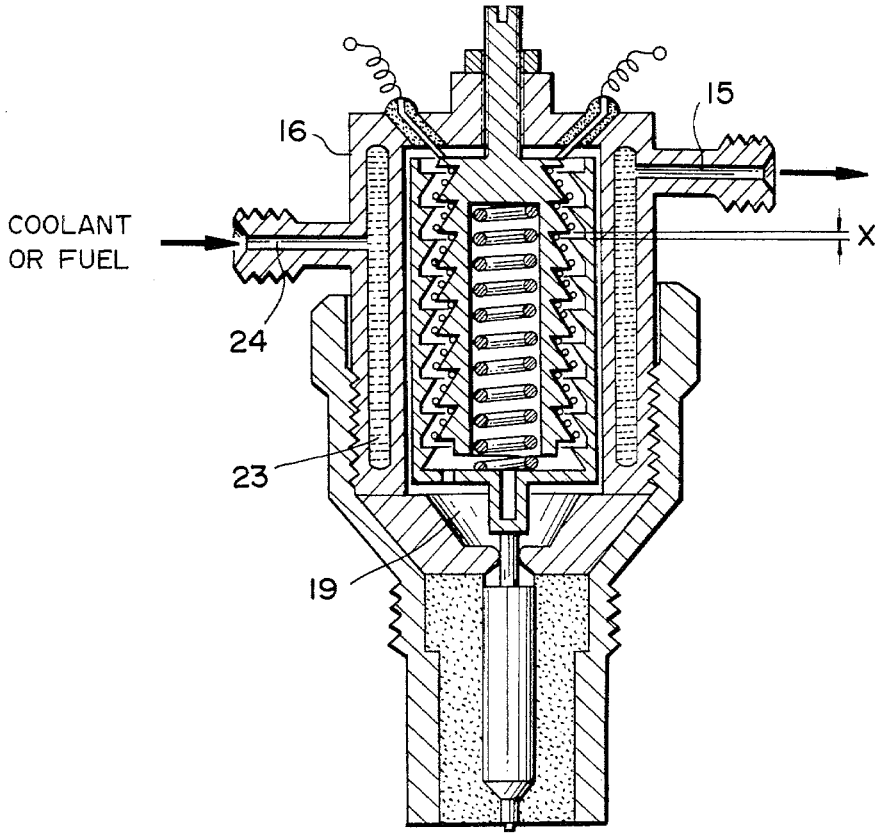
FIG. 4 is a vertical sectional view of a fourth embodiment of the present invention.

FIG. 4 shows a fourth embodiment. In this embodiment a cooling jacket 23 is provided around the solenoid holder 16, and the cooling water introduced from a cooling water inlet 24 is circulated through the jacket 23 before draining out through an water outlet 15. However, in this figure, the fuel passageway is not shown for simplification. The purpose of the jacket is to cool the solenoid unit for reducig thermal load caused by heat, and thereby the life of the solenoid unit is improved. In this embodiment, it is also possible to circulate fuel instead of cooling water.

Further, since an excessive fuel (seepage fuel from around the valve element) circulates through the cavity 19 within the housing 17, cooling effect may be obtained to some extent; however, it is possible to heighten the heat-resistance performance of the solenoid by positively cooling the solenoid. As shown in the second embodiment of FIG. 2, if seepage fuel is drained out after passed through the internal cavity of the solenoid, the cooling performance will further be improved.

As described above, according to the present invention, since the valve is opened or closed by a saw-toothed solenoid, it is possible to control fuel injection timing and period at a high speed under a high fuel pressure and thus to improve fuel consumption rate or exhaust gas quality of an injection-in-cylinder type engine. In addition, the use of a saw-toothed solenoid can realize a small-sized, light-weight fuel injection valve.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A fuel injection valve for an automotive vehicle, comprising:

(a) a housing having a nozzle at the one end portion thereof through which fuel is ejected, a valve seat portion proximate said nozzle, and a fuel passageway having an inlet portion formed in said housing near a middle portion thereof and an outlet portion formed in said housing near the nozzle;

(b) a valve element for opening and closing the nozzle, said valve element being disposed against the valve seat portion within said housing communicating with the fuel passageway, said valve element being urged in the direction of opening the nozzle when fuel pressure acts on the valve seat portion;

(c) a saw-toothed armature having radially extending flat surfaces and having said valve element at an end thereof, said armature being free to move in the axial direction within said housing;

(d) a saw-toothed core having radially extending flat surfaces and being provided with a coil wound around said saw-toothed core and energized by a unidirectional current, said core being fixed to said housing, the radially extending flat surfaces of said saw-toothed core forming a plurality of working surfaces in cooperation with the radially extending flat surfaces of said saw-toothed armature in order to actuate said armature in the axial direction, said saw-toothed core being operable to urge said armature in the direction of closing the nozzle when said coil is energized; and (e) a spring positioned between said armature and said core, said spring urging said armature in the direction to close the valve, the closing force of said spring being less than the opening force due to fuel pressure applied on said valve element, whereby said armature and said core cooperate to operate said valve element with a fast response time to open said nozzle when said coil is deenergized.

2. A fuel injection valve for an automotive vehicle as set forth in claim 1, wherein said saw-toothed core is adjustable in an axial direction therefor for setting a predetermined gap between the saw-teeth of said core and the saw-teeth of said armature.

3. A fuel injection vale for an automotive vehicle as set forth in claim 1, wherein said housing further comprises a fuel return outlet to return fuel seeping past said valve element to a fuel pump.

4. A fuel injection valve for an automotive vehicle as set forth in claim 1, wherein said housing further comprises a cooling jacket to cool said solenoid.

* * * * *